US006802464B2

(12) United States Patent
Marconnet

(10) Patent No.: US 6,802,464 B2
(45) Date of Patent: Oct. 12, 2004

(54) DEVICE FOR SPREADING LIQUID BINDER AND ROADSTONE BEHIND A ROAD MAKING MACHINE

(75) Inventor: Guy Marconnet, Saint Martin la Plaine (FR)

(73) Assignee: Famaro, Lorette (FR)

( * ) Notice: Subject to any disclaimer, the term of this patent is extended or adjusted under 35 U.S.C. 154(b) by 0 days.

(21) Appl. No.: 10/718,648

(22) Filed: Nov. 24, 2003

(65) Prior Publication Data

US 2004/0151545 A1 Aug. 5, 2004

(30) Foreign Application Priority Data

Nov. 25, 2002 (FR) ..... 02 14760
Aug. 4, 2003 (FR) ..... 03 09616

(51) Int. Cl.[7] ..... A01C 15/00

(52) U.S. Cl. ..... 239/650; 239/662; 239/663; 239/289; 239/159; 239/163; 239/170; 239/562; 404/91; 404/92; 404/101

(58) Field of Search ..... 239/650, 662, 239/663, 654, 289, 159, 161, 162, 163, 170, 562; 404/91, 92, 101, 113

(56) References Cited

U.S. PATENT DOCUMENTS 3,199,423 A * 8/1965 Dickey ..... 239/159
4,072,435 A * 2/1978 Coho et al. ..... 404/92
4,592,507 A * 6/1986 Benedict ..... 239/172
4,817,870 A * 4/1989 Dalton ..... 239/157
4,960,242 A * 10/1990 Larson ..... 239/168
5,069,578 A * 12/1991 Bense et al. ..... 404/92
5,125,764 A * 6/1992 Veath, Sr. ..... 404/108

FOREIGN PATENT DOCUMENTS

DE 44 03 243 8/1995
FR 2 817 568 6/2002
GB 2 102 865 2/1983

* cited by examiner

*Primary Examiner*—Robin O. Evans
(74) *Attorney, Agent, or Firm*—Young & Thompson

(57) ABSTRACT

The device comprises a roadstone spreader having roadstone flap-doors which are juxtapositioned the transverse direction and which are of equal width, and a rail for spreading bituminous binder facing spreading zones for roadstone via the roadstone flap-doors. The rail f comprises a first set of nozzles which produce jets which cover approximately three pitches of an impact zone of the road surface and nozzles of a second set of nozzles which are interposed between the nozzles of the first set and which are supplied in order to produce margin jets having an impact zone which extends approximately over two pitches over the road surface.

6 Claims, 5 Drawing Sheets

8
8'
T1
T2
L'
P
6
7a
7b
17
18
H
10
12
13
14
14a
14c
14d
15
15a
15b
15c
15d
16
19
6A
α
θ
θ/2

DEVICE FOR SPREADING LIQUID BINDER AND ROADSTONE BEHIND A ROAD MAKING MACHINE

The invention relates to a device for spreading liquid binder and roadstone behind a road making machine.

BACKGROUND OF THE INVENTION

Surface maintenance work of road surfaces by producing on the road surface a coating which is constituted by roadstone and a liquid binder, such as a bitumen emulsion or hot liquid bitumen, is usually carried out according to one of the two techniques which will be described below.

A spreading assembly which is constituted by a bitumen spreader and a roadstone spreader is used in order to produce the coating over large road surfaces. The spreader must spread the binder, which is either an emulsion or hot bitumen, over the highway with very great precision and excellent regularity in the transverse direction of the road surface and the spreading assembly. On the basis of the materials according to the prior art, use is made for this purpose of a rail having multiple jets, that is to say, a rail comprising nozzles which are distributed in the longitudinal direction of the rail which is arranged in the transverse direction of the road surface, with a constant spacing pitch, for example, a pitch of approximately 100 mm. The rail is supplied with liquid binder and the nozzles are constructed so as to produce a conical jet having a cross-section which is elongate in the transverse direction and which is similar to a triangular flat jet which meets the road surface over an impact surface whose length, in the transverse direction, depends on the apex angle of the flat jet and the height of the rail above the road surface. A rail height above the road surface is selected in accordance with the apex angle of the flat jets and the pitch of the nozzles over the rail so that the impact surface of each of the jets has a length of approximately three pitches in the transverse direction. Owing to the overlapping arrangement of the jets which are formed by the successive nozzles, three jets are superimposed on each of the pitches of the impact surface, which provides three coverings of the road surface.

The roadstone is generally deposited on the liquid binder which covers the road surface by a roadstone spreader which comprises a plurality of successive flap-doors of constant width which are distributed in the transverse direction of the road surface and which are controlled in order to open or close them so as to adjust the width for spreading roadstone over the road surface which is covered with liquid binder. In general, the multi-flap roadstone spreader is fixed to the bottom of the bucket of a tipping lorry, in which bucket the roadstone is loaded. In this manner, good transverse distribution is obtained.

This known technique using a spreading assembly results in surface coatings of excellent quality.

The surface maintenance of roads can require the treatment of localised faults, these works being generally designated in the art as emergency patching works. Such works can relate to isolated zones which are more or less circular or strips having a width less than the width of the road surface. In order to carry out such emergency patching works, a manual method has conventionally been used for some time consisting in applying the bitumen with a hand-held nozzle and spreading the roadstone using a roadstone container.

This rudimentary technique is used less and less and it is preferable to use materials which allow emergency patching works to be carried out in an automatic manner. The materials used are machines which combine on the same road making machine a small spreader and a small roadstone bucket which is associated with a roadstone spreader. Such machines have allowed advances in techniques for the surface maintenance of roads by mechanising the repair works and the practical and economic side of such machines which combine two functions explains their current success, in spite of the low level of autonomy thereof on site owing to the relatively small capacity of the roadstone bucket and the reservoir of liquid binder, such machines generally being constituted by a lorry.

A more disruptive disadvantage of this technique is that it leads to surface coatings of poor quality because the technique does not respect the principle which is implemented in spreading assemblies and which consists in depositing the bitumen on the road surface in three coverings. In order to carry out repair work to relatively small surfaces, the bitumen spreading rail is positioned at a height above the road surface which is less than the height usually used on spreading assemblies. Taking into consideration the apex angle of the flat jets and the pitch between the nozzles of the rail, each of the jets forms an impact surface whose dimension in the transverse direction is equivalent to only two pitches and the overlapping of the jets produces only two coverings, by two jets being superimposed over each of the pitches of the impact surface.

In the case of spreading assemblies, the width of the roadstone spreading flap-doors relative to the spacing pitch of the nozzles is further such that three jets of binder are applied over the spreading width of a flap-door. In automatic machines for emergency patching works, only two jets of binder are used per spreading width of a roadstone flap-door. The use of two coverings of binder instead of three and two jets of binder instead of three over a spreading width of a roadstone flap-door leads to surface coatings of lesser quality than that of the coatings obtained by means of a large-width spreading assembly.

Furthermore, local repairs carried out on strips of road surface by known automatic emergency patching techniques include faults along the edges or margins thereof. There are systematically overflows of binder as well as slippage of roadstone at the margins of the repaired strip owing to an under-metering of bitumen at the margins, which is linked structurally to the principle of these automatic machines.

These faults are present even if the binder rails of the automatic emergency patching machines are equipped with nozzles which are identical to the spreaders of the spreading assemblies with the same spacing pitch.

BRIEF SUMMARY OF THE INVENTION

Therefore, the object of the invention is to provide a device for spreading liquid binder and roadstone behind a road making machine comprising at least one binder spreading rail which is fixed to a rear portion of the road making machine, in a transverse direction, and having a first set of nozzles for spreading binder which are distributed over the length of the rail in the transverse direction with a constant spacing pitch and which are directed towards a road surface, on which the road making machine moves, and having adjustable means for supplying the rail with binder in order to supply all or some of the nozzles of the first set in order to form, at the outlet of each of the nozzles, a flat jet having an apex angle such that, in accordance with the height of the rail above the road surface, each jet has an impact surface on the road surface having a width of approximately three pitches in the transverse direction, and such that the jets of the first set of nozzles overlap in such a manner that, for each of the successive pitches of the impact surfaces of the jets, in the transverse direction, three jets are superimposed, and a roadstone spreader which is fixed to the rear of the road making machine, in a transverse arrangement facing the binder spreading rail, for spreading roadstone, comprising a plurality of flap-doors which are of equal width and which are juxtapositioned in the transverse direction and which are associated with control means, in order to open or close them, so as to allow or prevent the passage of a flow of roadstone having a constant width of approximately three pitches at the road surface for each of the flap-doors and to adjust the total spreading width of the roadstone spreader by all or some of the flap-doors being opened, this device allowing coatings of an excellent quality to be produced, at least equivalent to the quality of the coatings produced by spreading assemblies, and in particular emergency patching works to be carried out over strips of relatively small width, with a good level of quality for producing the coating at the margins of the repaired strip.

To this end:

the binder spreading rail further comprises a second set of nozzles which are each interposed between two successive nozzles of the first set of nozzles in the transverse direction and which are constructed so as to produce, when they are supplied with binder by the adjustable supply means of the rail, a first half-jet and a second half-jet each, which jets are successive in the transverse direction and which each have an impact surface of a width substantially equal to one pitch in the transverse direction and which are adjacent at one side and the other of an axis of the nozzle perpendicular to the transverse direction, the first half-jet which is located towards the end of the rail having a flow rate substantially double the flow rate of the second half-jet which is located towards the central portion of the rail, and the means for supplying the rail with binder are provided in order to ensure a selective supply of nozzles of the second set with a flow rate substantially equal to the supply rate of each of the nozzles of the first set, so that spreading of roadstone and liquid binder is brought about over a road surface width which is equal to a multiple of the spreading width of a flap-door, with two jets of liquid binder being superimposed over one pitch at each of the ends of the road surface width and three jets being superimposed over the other central pitches of the road surface, and with three jets of binder being spread for each of the spreading widths of a flow of roadstone from a flap-door of the roadstone spreader.

The device according to the invention can be constructed in such a manner that:

the flap-doors of the roadstone spreader pour roadstone directly onto the road surface, the spreading width of the roadstone from a flap-door being substantially equal to the width of a flap-door in the transverse direction;

the flap-doors of the roadstone spreader are associated with at least one of a distributor roller, a metering roller or a feeder or counter-feeder, and the spreading width of the roadstone over the road surface is greater than the width of the flap-doors of the roadstone spreader;

the nozzles of the first set and the nozzles of the second set are arranged on the same rail body;

the nozzles of the first set are arranged on a first rail body and the nozzles of the second set are arranged on a second rail body which is parallel with the first rail body;

the nozzles of the second set are each arranged at an identical distance from the nozzles of the first set, between which they are interposed in the transverse direction.

For a better understanding of the invention, a device for spreading liquid binder and roadstone according to the invention and the use thereof for emergency patching works will be described by way of example with reference to the appended Figures.

BRIEF DESCRIPTION OF THE SEVERAL VIEWS OF THE DRAWINGS

FIG. 3 shows the distribution of the flap-doors and nozzles of the binder spreading rail in the transverse direction.

FIG. 4 shows, in relation to FIG. 3, the disposition of the bitumen and coating jets in the case of repairs to the road surface carried out by the device according to the prior art.

DETAILED DESCRIPTION OF THE INVENTION

Figure 1:
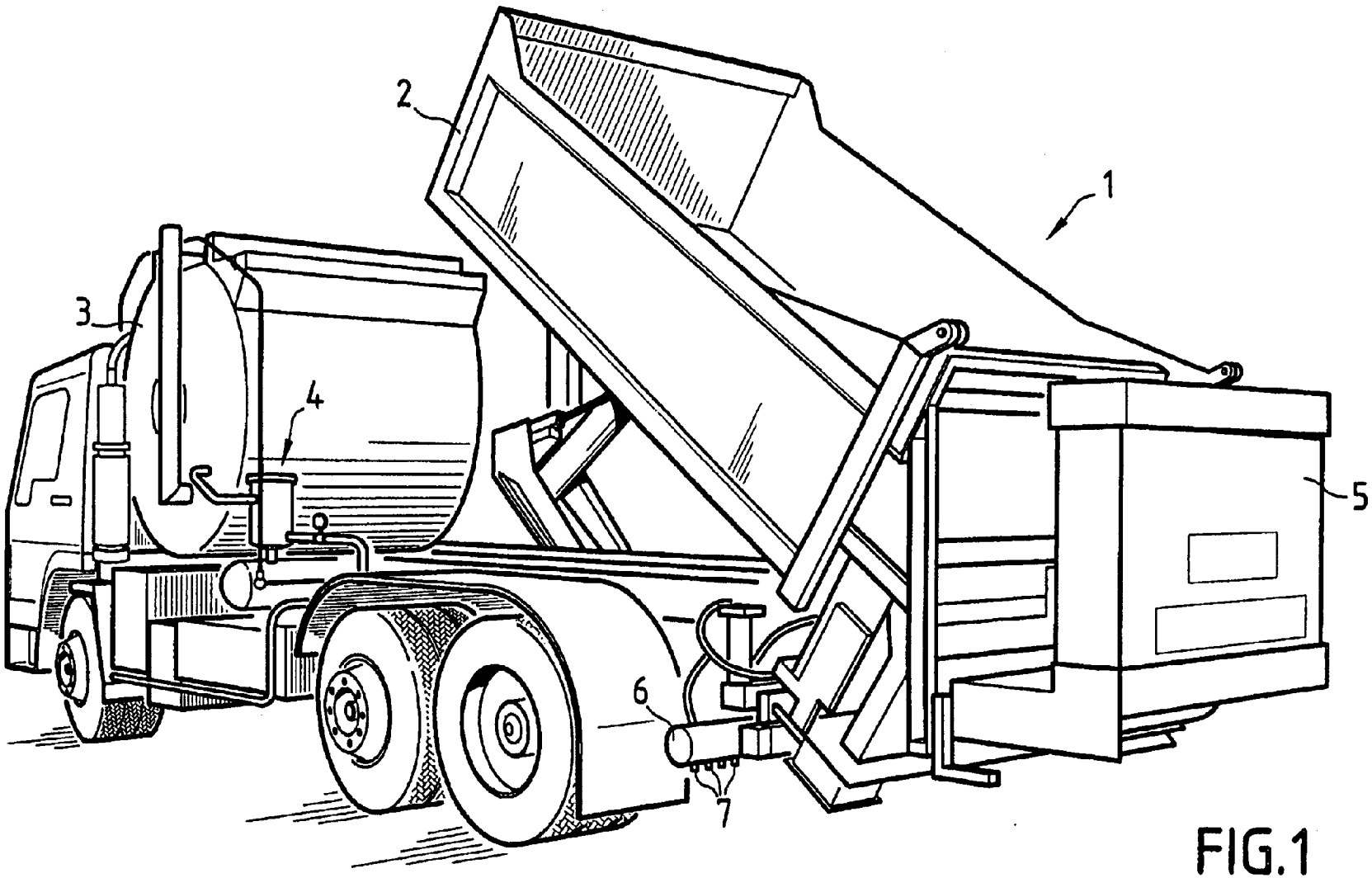
FIG. 1 is a schematic perspective view of a device according to the invention constituted by a tipping lorry which is equipped with a roadstone spreader and a bitumen rail.

FIG. 1 illustrates a device according to the invention which is generally designated 1 and which is constituted by a tipping lorry and whose platform carries a tilting bucket 2 and a reservoir of bituminous binder 3.

A roadstone spreader 5 is fixed to the rear portion of the tilting bucket 2 and allows roadstone contained in the bucket 2 to be spread over a road surface, on which the tipping lorry moves.

A rail 6 for spreading liquid bituminous binder is fixed under the chassis of the tipping lorry in front of the roadstone spreader and is supplied from the reservoir of liquid binder 3 by way of means 4 for pumping and distributing liquid binder to the rail 6.

Figure 2:
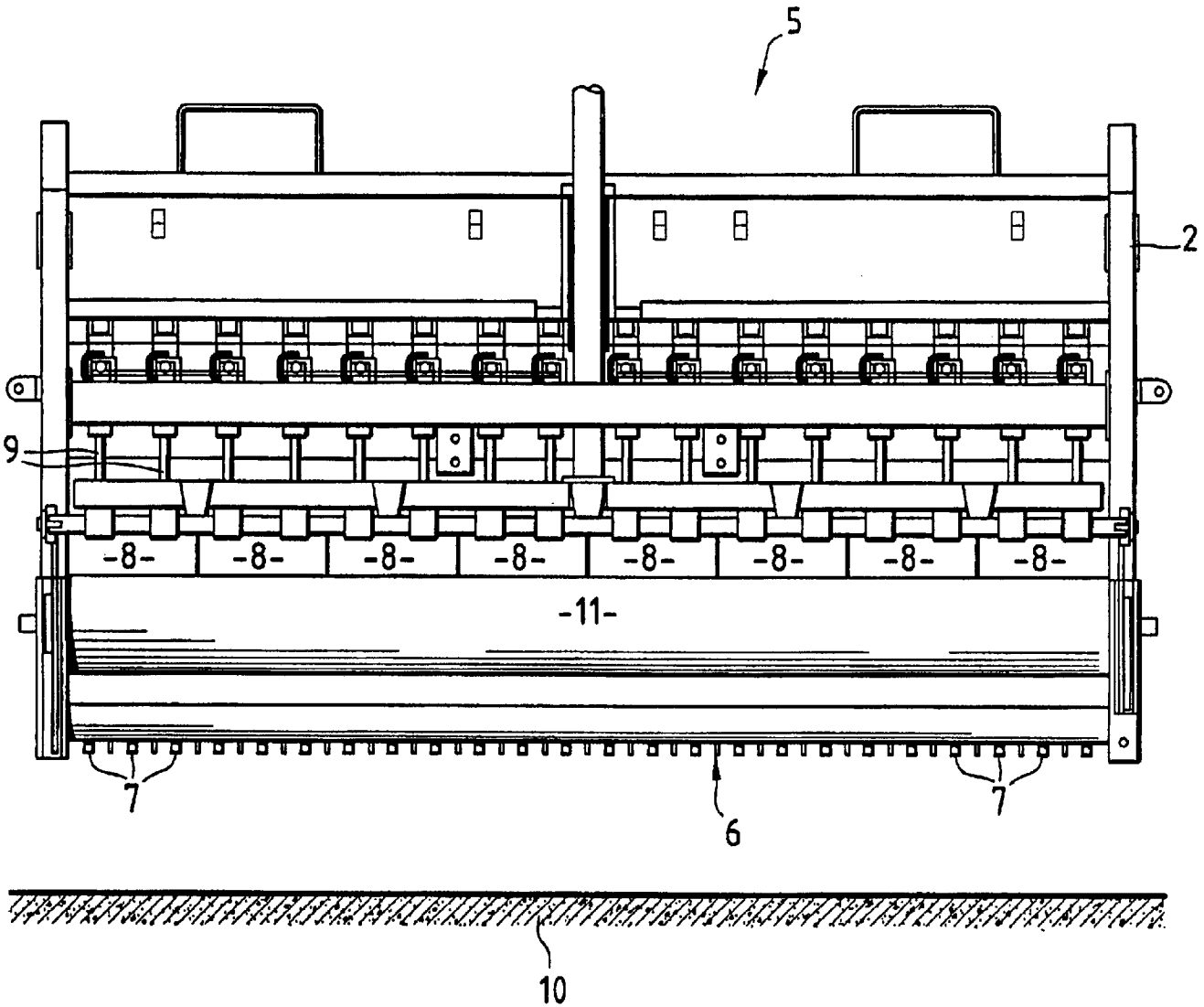
FIG. 2 is a rear view of the device, showing the arrangement of the flap-doors of the roadstone spreader and the bitumen rail.

As FIG. 2 shows, the roadstone spreader 5 in particular comprises a plurality of flap-doors 8 which are of constant width in the transverse direction of the tipping lorry and which are arranged one after the other in the transverse direction over the entire width of the bucket.

The flap-doors 8 are controlled individually in order to open or close them by actuators 9 so that it is possible to adjust the spreading width of the roadstone spreader 5 by opening all or some of the flap-doors 8 in the transverse direction.

The rail for spreading bituminous liquid binder 6 comprises nozzles 7 which are distributed in the transverse direction with a constant spacing interval or pitch.

The nozzles 7 are supplied with liquid bituminous binder by the pumping and distribution means 4 which are associated with the reservoir 3 so that it is possible to supply all or some of the nozzles 7 with a controlled flow rate of liquid bituminous binder.

The rail 6 is positioned in the transverse direction facing the row of flap-doors 8 of the roadstone spreader, the length of the rail 6 which carries the nozzles 7 in the transverse direction being able to be substantially equal to or greater than the length of the row of flap-doors 8.

By a flap-door 8 being opened, roadstone is caused to pour out and can fall onto the road surface 10 directly perpendicularly relative to the open flap-door 8, or by means of a distributor roller 11 and a feeder which brings about a widening of the pouring of roadstone by the flap-door 8 over the road surface 10.

When the roadstone falls directly from the flap-doors 8 onto the road surface 10, the spreading width of each of the flap-doors is substantially equal to the width of the flap-door in the transverse direction. When a feeder is used, optionally associated with a distributor roller, the spreading width of each of the flap-doors 8 is greater than the width of the flap-doors. In all cases, the spreading width on the ground of each of the flap-doors 8, that is to say, the width in the transverse direction of the flow of roadstone released by the flap-door 8 and deposited on the ground, will be considered.

The nozzles 7, whose spacing is constant in the transverse direction, that is to say, in the longitudinal direction of the rail 6, are distributed in the transverse direction in accordance with the spreading width of the flap-doors, that is to say, the spreading width of each of the individual flap-doors and the total spreading width.

Figure 3:
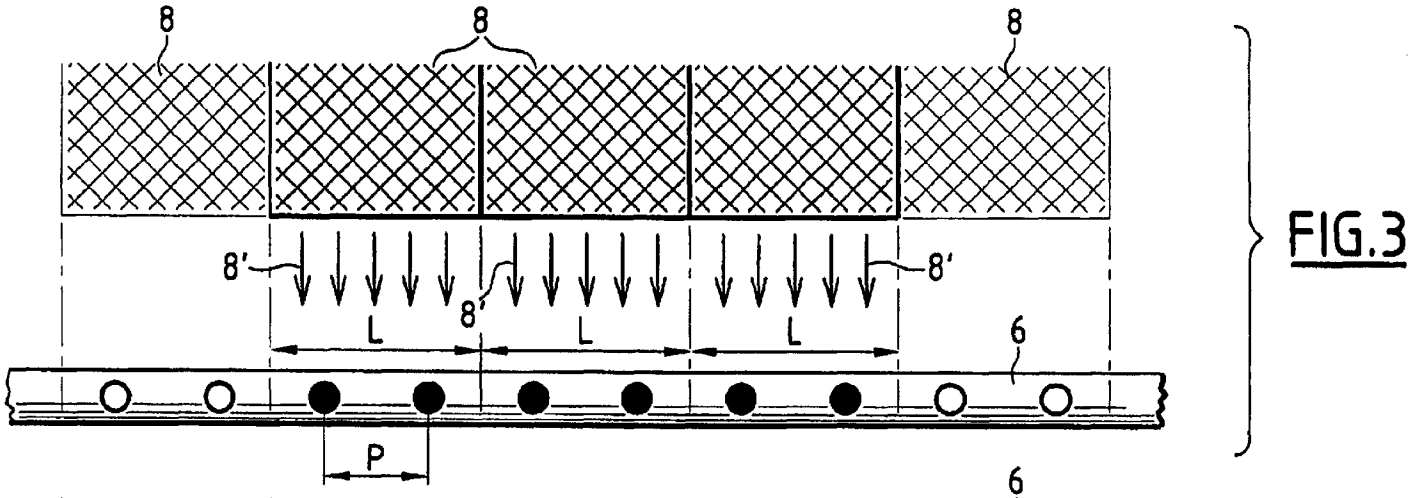
FIGS. 3 and 4 are schematic views relating to an automatic device for carrying out emergency patching works according to the prior art.
Figure 4:
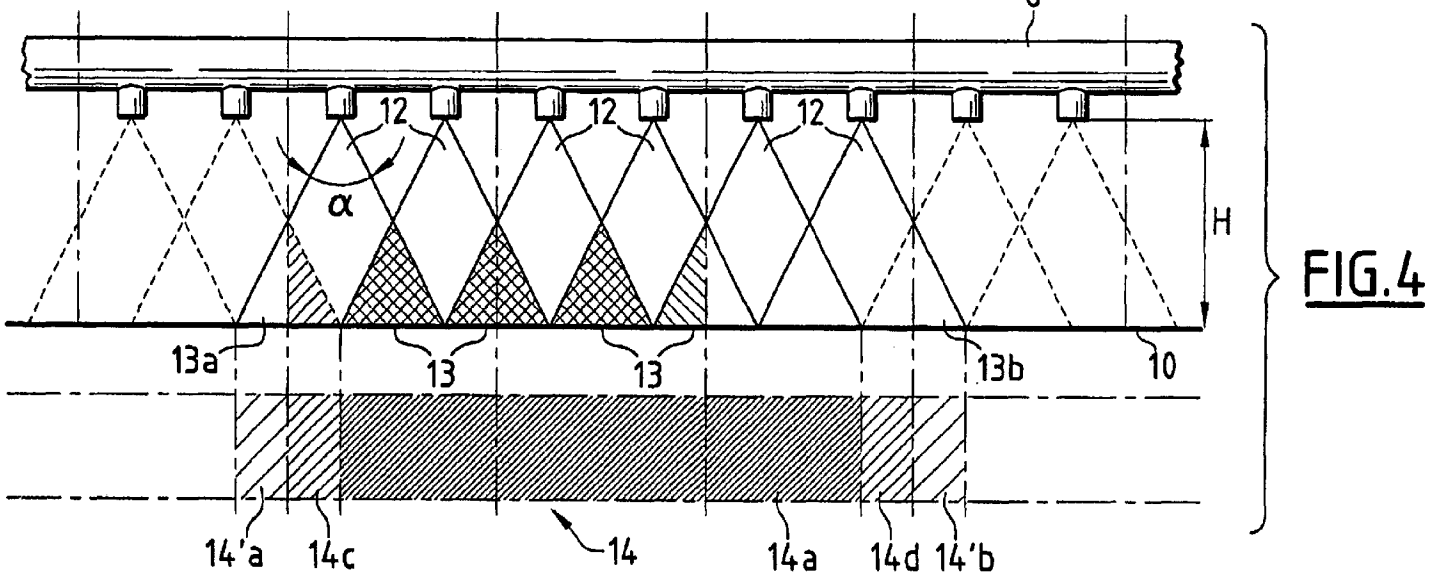

FIGS. 3 and 4 illustrate schematically a portion of a rail 6, over the length thereof, in the transverse direction of the spreading device. The rail 6 is a rail according to the prior art, as used, for example, for emergency patching works, on an automatic device which can be similar to the device illustrated in FIG. 1.

The rail 6 comprises nozzles 7 which are spaced from each other at a constant spacing pitch P in the transverse direction.

The position of the successive flows 8' of roadstone, which are poured out through the flap-doors 8 of a roadstone spreader having an adjustable spreading width, relative to the nozzles 7 of the rail 6 in the transverse direction is illustrated above the rail 6.

If a flow-widening feeder is not used, the flows 8' have a width L substantially equal to the width of the flap-doors 8 in the transverse direction.

The positions of the nozzles 7 and the jets of bitumen which will be described in relation to FIGS. 3 and 4 are determined relative to the flows of roadstone 8' of width L at the ground coming from the flap-doors 8.

As FIG. 3 shows, two nozzles 7 of the rail 6 are provided facing each of the spreading flows 8' of a flap-door 8 in the case of a bitumen spreading device according to the prior art for emergency patching works.

FIGS. 3 and 4 relate to the use of a device according to the prior art in order to bring about repairs to a strip of the road surface having a width substantially equal to three times the spreading width of a flap-door 8, that is to say, having a width substantially equal to six times spacing pitch P of the nozzles 7 of the rail 6.

In the case of nozzles having a spacing pitch in the order of 100 mm, the width of the strip being repaired is in the order of 600 mm.

FIG. 4 illustrates, in the upper portion, the rail 6 and the jets 12 of bituminous binder which are formed by the successive nozzles 7 of the rail 6, which nozzles 7 are positioned at a height h which is substantially equal to two-thirds of height H of a rail used in a spreading assembly for works of great width.

The jets 12 formed by the nozzles 7 of the rail 6 which have a triangular flat shape and an apex angle a have an impact surface on the road surface 10 whose width in the transverse direction is substantially equal to two pitches of the rail 6.

The successive pitches 13 in the transverse direction of the impact surface of the jets 12 on the road surface 10 each correspond to half of the width of the impact surface of a jet 12.

When repairs are carried out to a strip 14, as illustrated in the lower portion of FIG. 4, over a width equal to three times the spreading width L of a flap-door 8, six successive nozzles 7 are supplied in order to form six adjacent jets of bitumen 12 which overlap in such a manner that the pitches 13 of the impact surface, which is located in the central portion of the treated zone 14, between the end pitches 13*a* and 13*b*, are constituted by overlapping and covering by two jets 12, these pitches 13 having two coverings.

The end pitches 13*a* and 13*b* comprise only one covering and the jets extend outside the zone 14, in which the pouring of roadstone is carried out.

Figure 5:
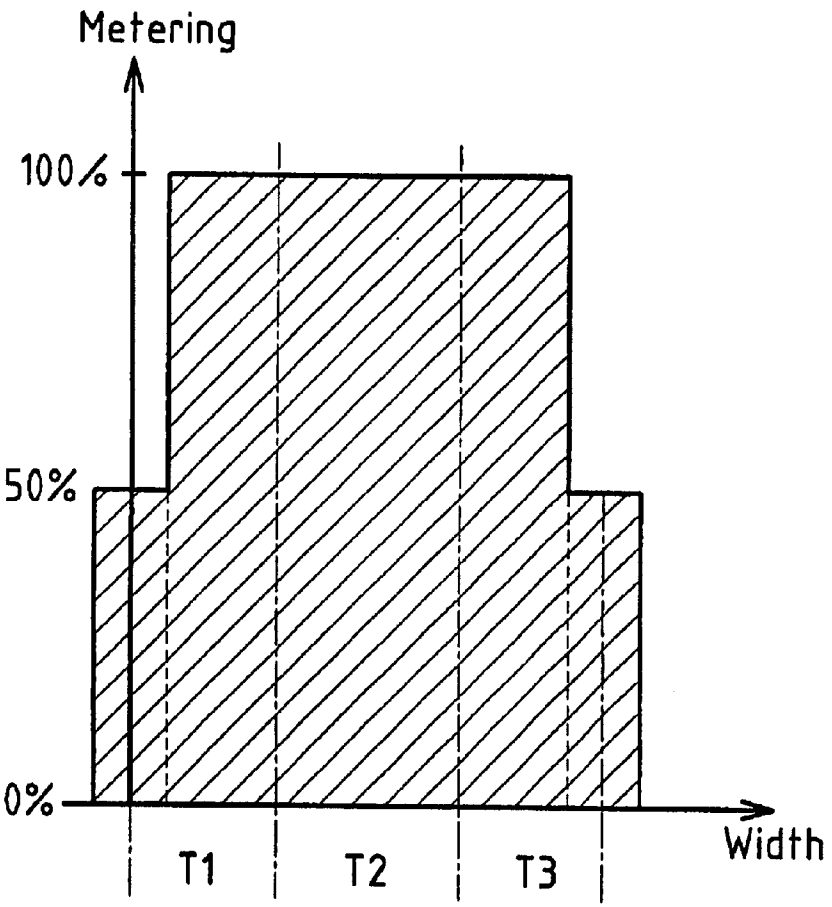
FIG. 5 is a histogram showing the distribution of binder over the width of a strip which is being repaired by an automatic emergency patching device according to the prior art.

FIG. 5 is a histogram giving, on the ordinate, the metering or density of bitumen at the impact surface of the jets relative to the maximum covering density of the method and, on the abscissa, the spreading zones of the three flap-doors 8 for roadstone which are located above the treatment zone 14.

In FIG. 4 (lower portion), the zone 14 which extends over the three successive spreading zones of the three roadstone flap-doors has also been illustrated.

In the central zone for spreading roadstone (zone T2 for spreading roadstone from the second flap-door 8 when viewed from the left), the density of coverage by the bitumen is 100% and corresponds to two coverings by bitumen jets 12.

In the two zones T1 and T3 at one side and the other of the central zone T2 which correspond to the spreading zones of the first roadstone flap-door 8 and the third roadstone flap-door 8, the spreading density is 100% and corresponds to two coverings by jets 12 over two-thirds of the zone starting from the central zone.

FIG. 4 shows that the jets 12 overlap so as to produce two coverings starting from the second pitch 13 of the covering zone and as far as the penultimate pitch 13, these pitches 13, as indicated above, having a length in the transverse direction equal to half of width L of a roadstone spreading zone 8' (T1, T2 or T3).

Over the first pitch 13 of the impact zone of the jets 12, in the treated zone 14, and over the last pitch, the impact zone comprises only one covering, which represents 50% of the density of binder in the central zone, as illustrated in FIG. 5.

Furthermore, the first jet 12 at the left limit of the zone 14 and the last jet at the right limit of the zone 14 extend by a half-pitch 13*a* or 13*b*, respectively, beyond the zone 14, in which roadstone is spread.

As illustrated in FIG. 5, the margin zones having a width of a half-pitch of the impact zone and the two projecting zones 13*a* and 13*b* are covered in bitumen at a density of 50% of the maximum density in the central zone.

FIG. 4 (lower portion) illustrates the central portion 14*a* of the zone 14, in which the road surface 10 receives two coverings of liquid bituminous binder, the margin zones 14*c* and 14*d* having a width of a half-pitch of the covering zone, in which the road surface 10 receives only a single covering of bitumen from a single jet 12, and the two zones 14'*a* and 14'*b* having a width of a half-pitch, outside the treated zone 14, to the left and right, which correspond to the half-pitches 13*a* and 13*b* of the impact zone outside the roadstone deposit zone which receives a covering of bitumen from a single jet 12.

Finally, the central portion 14*a* of the treated zone is of average quality and poorer than the quality of a coating carried out over a large width, because it comprises only two coverings of bitumen.

The lateral portions 14*c* and 14*d* which comprise only one covering of bitumen cannot ensure sufficient adhesion for the roadstone which is readily removed and the projecting zones 14'*a* and 14'*b*, outside the roadstone deposit zone, have run-outs of bitumen which are detrimental to the good quality of the highway and which are not used to ensure the adhesion of the roadstone.

Figures 6, 6A, 7:
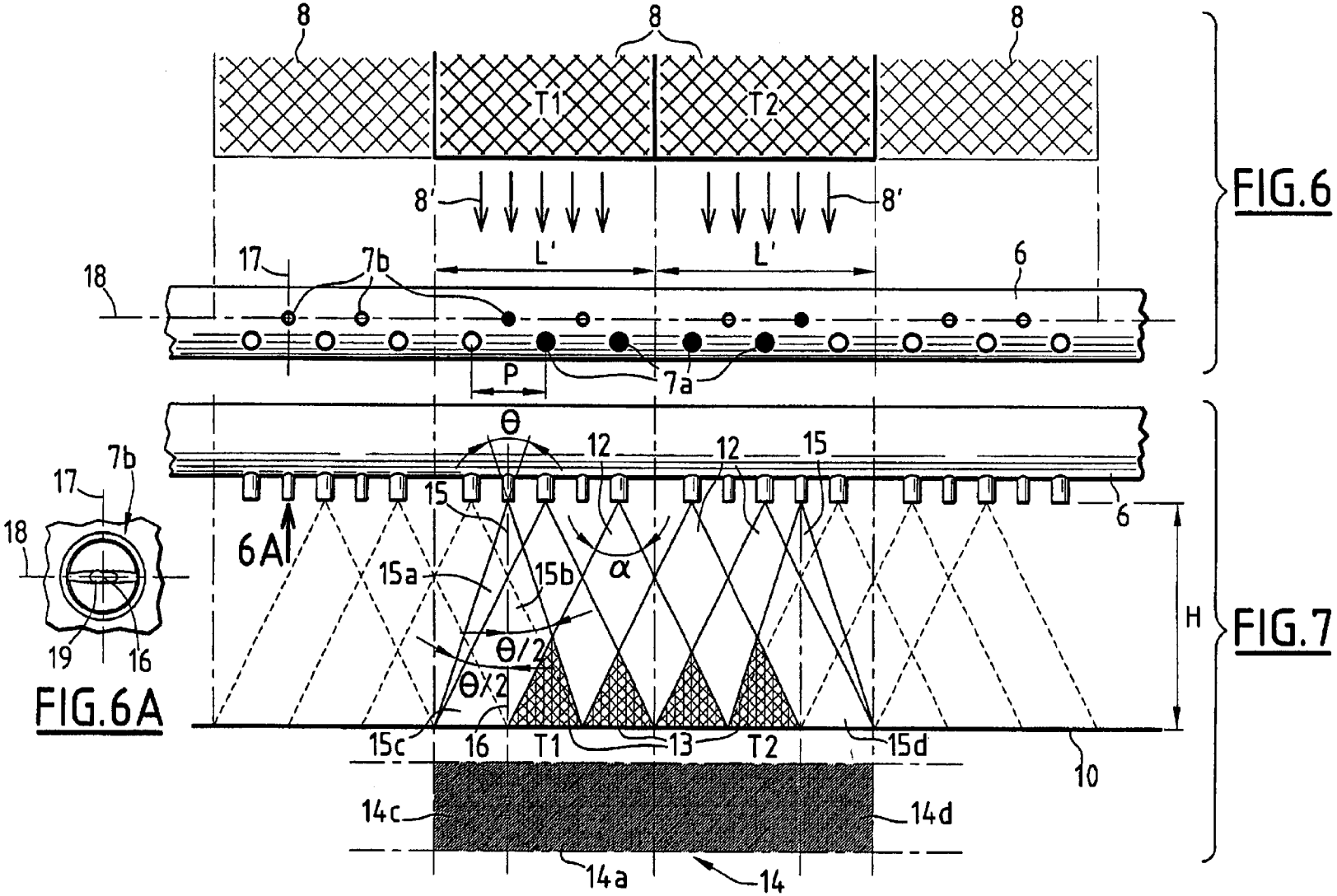
FIG. 6 is a schematic view similar to the view in FIG. 3, in the case of a spreading device according to the invention.
FIG. 6*a* is a view from below of a nozzle of the second set of nozzles of the device of FIG. 6 or FIG. 7.
FIG. 7 is a view similar to the view in FIG. 4, showing the distribution of the jets of liquid binder and roadstone in the case of the device according to the invention.

FIGS. 6 and 7 illustrate, in the same manner as in FIGS. 3 and 4, the arrangement of the nozzles of a rail 6 for spreading liquid binder of a device according to the invention, relative to the successive zones for spreading flows of roadstone 8' having width L' from the roadstone flap-doors 8 of a roadstone spreader having a variable width according to the invention.

In comparison with the device according to the prior art, the rail 6 of the device according to the invention comprises a first set of nozzles 7*a* which are arranged with constant spacing pitch P which can be, for example, 100 mm, and therefore equal to the spacing pitch of the nozzles of the rail 6 according to the prior art described above, and a second set of nozzles 7*b* which are each arranged in the transverse direction between two nozzles 7*a* of the first set of nozzles.

As will be explained below, the nozzles 7*b* of the second set of nozzles are preferably, but not necessarily, arranged at an identical distance from the nozzles of the first set, between which they are positioned, in the transverse direction which corresponds to the longitudinal direction of the rail 6.

In FIG. 6 (lower portion), the rail 6 has been illustrated from below, the Figure showing the surface of the rail directed towards the road surface 10.

The nozzles of the first set 7*a* are aligned along a first longitudinal axis of the rail 6 and the nozzles 7*b* of the second set along a second longitudinal axis. This arrangement facilitates the connection of the nozzles to the means for supplying liquid bituminous binder from the reservoir 3 by way of pumping and distribution means 4.

In some cases, in accordance with the spacing pitch of the nozzles of the first set and the dimensions of the means for connecting the nozzles, it is possible to position the nozzles 7*b* of the second set between the nozzles of the first set, along the same longitudinal axis of the rail 6.

The width of the roadstone flap-doors 8 has been increased relative to the device according to the prior art so that width L' of the roadstone spreading zones 8' in the transverse direction is equal to one and a half times width L of the roadstone spreading zones 8' in the device according to the prior art.

In this case, in order to carry out repairs to a zone 14 as illustrated in FIG. 7 having an identical width, only two roadstone flap-doors 8 are used whose opening ensures the spreading of roadstone over two zones of width L' which are designated roadstone spreading zones T1 and T2.

Facing each of the spreading zones of a flap-door, such as T1 and T2, as can be seen in FIG. 6, the rail comprises three nozzles 7*a* of the first set and two nozzles 7*b* of the second set which are each interposed between two nozzles 7*a* of the first set.

However, only some of the nozzles 7*a* and nozzles 7*b* located facing the roadstone spreading zones T1 and T2 are supplied with bitumen.

In FIG. 6 (lower portion), a black circle represents the nozzles which are supplied with liquid bituminous binder and a white circle represents the nozzles which are not supplied with liquid bituminous binder when the device according to the invention is used for carrying out repairs in a strip-like zone 14.

The four central nozzles 7*a* of the first set of nozzles are supplied, similarly to the two nozzles 7*b* of the second set which are located immediately in front of the first supplied nozzle 7*a* of the first set and immediately after the last supplied nozzle 7*a* of the first set in the transverse direction, that is to say, in the longitudinal direction of the rail and in the sense from left to right in FIG. 6.

As illustrated in FIG. 7 (upper portion), the rail is further positioned at height H which is the usual rail height when large-width road coatings are carried out for road maintenance. This height is generally 50% greater than rail height h which is used for emergency patching works with automatic machines.

The angles $\alpha$ of the flat jets 12 are such that, in accordance with height H, the four central jets of the nozzles 7*a* of the first set each have an impact zone which extends over three pitches at the road surface 10 and which overlap in such a manner that the four central pitches 13 of the impact zone have three coverings of liquid bituminous binder which are constituted by three jets being superimposed.

The two nozzles 7*b* of the second set, which are located towards the outside and at one side and the other of the set of four supplied nozzles 7*a* of the first set, are supplied with bitumen at a flow rate substantially equal to the supply rate of the nozzles 7*a* and are constructed in such a manner that the jets 15 which are formed by these nozzles of flat triangular shape and which have an apex angle h overlap the road surface 10 over an impact zone having a width of two pitches in the transverse direction, taking into consideration height H of the rail 6. Consequently, the jets 15 overlap two jets 12 over a central pitch 13 of the zone 14 and a single jet 12, over a first pitch 15*c* and over a last pitch 15*d* of the impact zone, in the transverse direction from left to right.

The jets 15 are known as margin jets because they allow the margins of the zone 14 to be covered as far as the precise limit of the zone 14 in the transverse direction, that is to say, as far as the limits of the roadstone spreading zone.

Since the jets 12 produced by the nozzles of the first set at the ends of the row of nozzles themselves produce jets which are completely limited to the roadstone deposit zone, the liquid bituminous binder is completely limited, in the transverse direction, to the limits of the roadstone deposit zone. No bituminous binder is therefore lost as a result.

As FIG. 6A shows, the nozzles 7*b* have an asymmetrical opening 19 at one side and the other of a plane 17 perpendicular to the axis 18 of the rail 6 extending through the vertical axis 16 of the nozzle, the cross-section of the opening of the nozzle 7*b* at one side and the other of the plane 17 being such that the flow rate of the nozzle at one side of the plane 17 is double the flow rate passing at the other side of the plane 17. Therefore, the jet 15 of the nozzles 7*b* is formed by two half-jets 15*a* and 15*b* which each cover the road surface over the width of a pitch and which have flow rates which are equal to two-thirds and one-third of the total supply rate q of the nozzle 15, respectively. If the nozzle is supplied at flow rate q, the two half-jets have respective flow rates of 2q/3 and q/3.

The nozzles are arranged on the rail 6 in such a manner that the portion of the nozzle forming the half-jet having a maximum flow rate is located towards the outside of the rail, that is to say, which is directed towards an end, and the portion forming the half-jet having a minimum flow rate is located towards the central portion of the rail 6.

The margin portions of the impact zone of the bitumen jets extending over the end pitches 15*c* and 15*d* comprise two coverings of bituminous binder, one of the coverings being formed at a flow rate of 2q/3 and the other at a flow rate of q/3 (one-third of the flow rate of a nozzle 7*a*). The covering of the end pitches 15*c* and 15*d* is therefore similar to the covering of all of the central pitches 13 which are formed by three coverings at a flow rate of q/3. The covering layer is therefore completely constant, which ensures a very good quality of the coating constituted by roadstone and bituminous binder.

As FIG. 7 shows (lower portion), all of the zone 14, in which the repairs are being carried out, is of excellent quality because the layer of bitumen is of a constant thickness over the entire road surface. The lateral zones 14*c* and 14*d* corresponding to the pitches 15*c* and 15*d* of the impact zone at the margins of the strip, in which the repairs are being carried out, have only two coverings of bitumen, but a density of bitumen similar to the central zone, which provides an excellent key for the roadstone at the margins of the repair strip. Furthermore, no run-out of bitumen is produced outside the zone 14, whose width corresponds to the roadstone spreading zone.

Therefore, the device according to the invention allows repairs to be carried out over a width of the road surface equal to a whole multiple of the spreading width of a roadstone flap-door which is itself substantially equal to three times the spacing pitch of the nozzles of the first set of nozzles, with a surface density of bitumen which is constant in a central zone of the repair strip in two margin zones, whose limits correspond exactly to the limits of the roadstone spreading zone.

The invention has been described in the case where repairs are carried out over a strip of a width equal to two roadstone spreading widths or six spacing pitches of the nozzles of the first set of the rail. It is possible to carry out repairs over strips which generally have a width equal to a whole multiple equal to two or more spreading widths of a roadstone flap-door. In the case of a strip having a width equal to three times the spreading width of a flap-door 8 of the roadstone spreader, seven successive nozzles 7*a* of the first set of nozzles and two margin nozzles 7*b* of the second set at one side and the other of the seven nozzles of the first set are supplied with bituminous binder.

In the case of a strip having the width of four spreading widths of roadstone flap-doors of the roadstone spreader, ten nozzles 7*a* of the first set and two margin nozzles are supplied.

Figure 8:
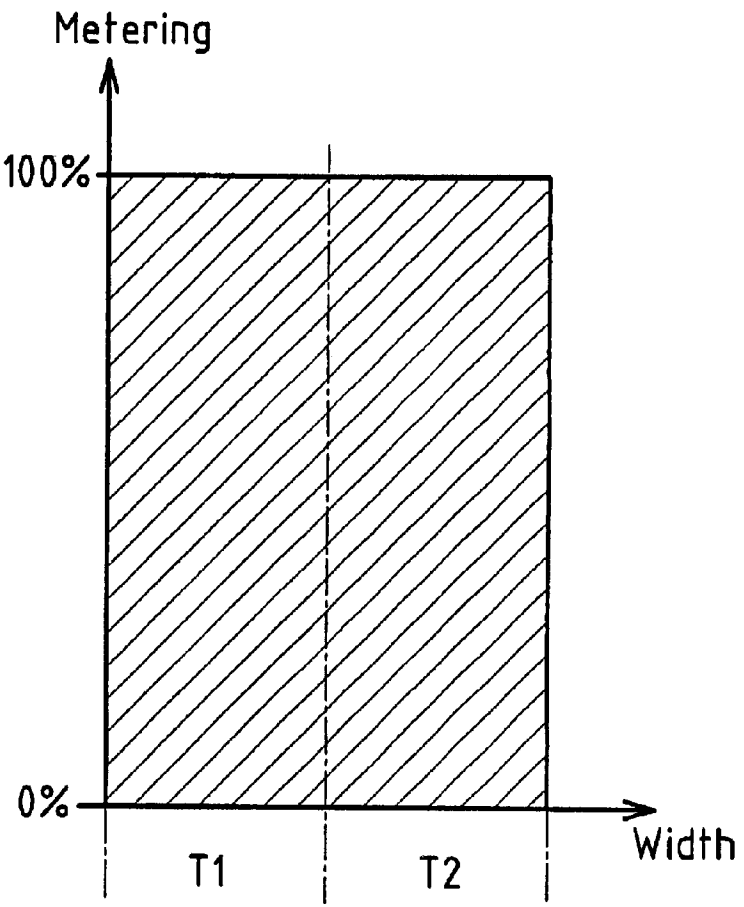
FIG. 8 is a histogram showing the distribution of binder over the width of a strip which is being repaired by the device according to the invention.

As shown in FIG. 8, in the case of a repair strip having the width of two roadstone spreading zones T1 and T2, the two zones T1 and T2 of the repair zone have a metering of bitumen of 100% which corresponds to three coverings by bitumen jets 12 or two coverings by jets 12 and one covering by an inner half-jet 15*b* of a nozzle 7*b* or one covering by a jet 12 and one covering by an outer half-jet 15*a* of a nozzle 7*b*.

Therefore, the device according to the invention allows repair strips of excellent quality to be produced with the width being adjusted in accordance with a multiple of the spreading width of a flap-door of the roadstone spreader corresponding to three spacing pitches of the nozzles of the first set of nozzles, this unit width being able to be in the order of 300 mm. In particular, the device is well-suited to the conventional case of repairs over strips of a width of 600 mm. In this case, in addition to the advantages relating to the construction quality of the repair strip, substantial economic advantages are obtained by preventing wastage of bituminous binder and roadstone. It has been found that savings of up to 16% of binder and 16% of roadstone are made for works having a width of 600 mm.

The device according to the invention can comprise a roadstone spreader of any type, provided that the roadstone spreader comprises a device for adjusting the width for depositing roadstone from flap-doors whose opening and closing is controlled.

The roadstone spreader can operate on the basis of any principle for metering and guiding the roadstone and, in particular, the device according to the invention can comprise a gravity metering roadstone spreader, a distributor roller roadstone spreader, a metering roller roadstone spreader with or without a feeding and counter-feeding system. As indicated above, the spreading width for the roadstone poured out via each of the flap-doors can be substantially equal to or greater than the width of a flap-door.

In the embodiment described, the nozzles of the second set, which are interposed between the nozzles of the first set and which are supplied in order to provide the margin jets, are arranged at an identical distance from the jets of the first set. The margin jets 15 are, in this case, symmetrical jets which are constituted by two half-jets having an apex angle of h/2. It is also possible to arrange the nozzles of the second set between the nozzles of the first set in the transverse direction at different distances from the two nozzles of the first set, between which they are interposed. In this case, asymmetrical margin jets are formed which are constituted by two half-jets having different apex angles and which are intended to cover two pitches of the impact zone in the transverse direction.

In the embodiment described, the nozzles of the first set 7*a* and the nozzles of the second set 7*b* are fixed to the same rail body 6. The rail can also comprise two parallel rail bodies which are positioned facing each other in the transverse direction. In this case, it is possible to install the first set of nozzles 7*a* on a first rail body and the second set of nozzles 7*b* on the second rail body which is parallel with the first.

In any case, the nozzles, and in particular the nozzles of the second set, are controlled and supplied independently of each other.

The invention relates mainly to repair works of the emergency patching type; however, these repairs can be carried out over strips of any width.

What is claimed is:

1. Device for spreading liquid binder and roadstone behind a road making machine (1) comprising at least one binder spreading rail (6) which is fixed to a rear portion of the road making machine (1), in a transverse direction, and having a first set of nozzles (7) for spreading binder which are distributed over the length of the rail (6) in the transverse direction with a constant spacing pitch (P) and which are directed towards a road surface (10), on which the road making machine (1) moves, and having adjustable means (4) for supplying the rail (6) with binder in order to supply all or some of the nozzles (7*a*) of the first set in order to form, at the outlet of each of the nozzles (7*a*), a flat jet (12) having an apex angle ($\alpha$) such that, in accordance with height (H) of the rail (6) above the road surface (10), each jet (12) has an impact surface on the road surface (10) having a width of approximately three pitches in the transverse direction, and such that the jets (12) of the first set of nozzles overlap in such a manner that, for each of the successive pitches (13) of the impact surfaces of the jets (12), in the transverse direction, three jets (12) are superimposed, and a roadstone spreader (5) which is fixed to the rear of the road making machine (1), in a transverse arrangement facing the binder spreading rail (6), for spreading roadstone, comprising a plurality of flap-doors (8) which are of equal width and which are juxtapositioned in the transverse direction and which are associated with control means (9), in order to open or close them, so as to allow or prevent the passage of a flow of roadstone (8') having a constant width of approximately three pitches at the road surface (10) for each of the flap-doors (8) and to adjust the total spreading width of the roadstone spreader (5) by all or some of the flap-doors (8) being opened, wherein:

the binder spreading rail (6) further comprises a second set of nozzles (7*b*) which are each interposed between two successive nozzles (7*a*) of the first set of nozzles in the transverse direction and which are constructed so as to produce, when they are supplied with binder by the adjustable supply means (4) of the rail (6), a first half-jet and a second half-jet each, which jets are successive in the transverse direction and which each have an impact surface of a width substantially equal to one pitch in the transverse direction and which are adjacent at one side and the other of an axis (16) of the nozzle (7*b*) perpendicular to the transverse direction, the first half-jet (15*a*) which is located towards the end of the rail (6) having a flow rate substantially double the flow rate of the second half-jet (15*b*) which is located towards the central portion of the rail (6), and the means (4) for supplying the rail (6) with binder are provided in order to ensure a selective supply of nozzles (7*b*) of the second set with a flow rate substantially equal to the supply rate of the nozzles (7*a*) of the first set, so that spreading of roadstone and binder is brought about over a width of road surface (10) which is equal to a multiple of the spreading width of a flap-door (8), with two jets of binder being superimposed over one pitch (15*c*, 15*d*) at each of the ends of the width of road surface (10) and three jets (15, 12) being superimposed over all of the other central pitches (13) of the width of road surface (10), and with three jets of binder being spread for each of the spreading widths of a flow of roadstone (8') from a flap-door (8) of the roadstone spreader (5).

2. Device according to claim 1, wherein the flap-doors (8) of the roadstone spreader pour roadstone directly onto the road surface (10), the spreading width of the flow of roadstone (8) from a flap-door (8) being substantially equal to the width of the flap-door (8) in the transverse direction.

3. Device according to claim 1, wherein the flap-doors (8) of the roadstone spreader are associated with at least one of a distributor roller (11), a metering roller or a feeder or counter-feeder, and in that the width of the flow of roadstone (8) over the road surface (10) is greater than the width of the flap-doors (8) of the roadstone spreader (5).

4. Device according to claim 1, wherein the nozzles of the first set (7*a*) and the nozzles of the second set (7*b*) are arranged on the same rail body (6).

5. Device according to claim 1, wherein the nozzles (7*a*) of the first set are arranged on a first rail body and the nozzles (7*b*) of the second set are arranged on a second rail body (6) which is parallel with the first rail body.

6. Device according to claim 1, wherein the nozzles (7*b*) of the second set are each arranged at an identical distance from the nozzles (7*a*) of the first set, between which they are interposed in the transverse direction.

* * * * *